US009455070B2

(12) United States Patent
Gareis

(10) Patent No.: US 9,455,070 B2
(45) Date of Patent: Sep. 27, 2016

(54) SEMI-SOLID UNBALANCED AUDIO CABLE

(71) Applicant: Belden Inc., St. Louis, MO (US)

(72) Inventor: Galen Gareis, Oxford, OH (US)

(73) Assignee: BELDEN INC., St. Louis, MO (US)

( * ) Notice: Subject to any disclaimer, the term of this patent is extended or adjusted under 35 U.S.C. 154(b) by 106 days.

(21) Appl. No.: 14/163,824

(22) Filed: Jan. 24, 2014

(65) Prior Publication Data

US 2015/0179306 A1 Jun. 25, 2015

Related U.S. Application Data

(60) Provisional application No. 61/920,618, filed on Dec. 24, 2013.

(51) Int. Cl.

| | |
|---|---|
| ***H01B 7/00*** | (2006.01) |
| ***H01B 7/30*** | (2006.01) |
| ***H01B 11/04*** | (2006.01) |
| ***H01B 11/12*** | (2006.01) |
| *H01B 11/18* | (2006.01) |
| *H01B 7/18* | (2006.01) |

(52) U.S. Cl.

CPC ..... *H01B 7/30* (2013.01); *H01B 11/04* (2013.01); *H01B 11/12* (2013.01); *H01B 11/1886* (2013.01); *H01B 7/1895* (2013.01); *H01B 11/1847* (2013.01)

(58) Field of Classification Search

USPC ..... 174/110–110 PM, 115, 116, 120 R, 174/120 SR, 121 R, 121 SR

See application file for complete search history.

(56) References Cited

U.S. PATENT DOCUMENTS

| | | | | |
|---|---|---|---|---|
| 2,038,973 | A * | 4/1936 | Wentz | 174/29 |
| 2,210,400 | A * | 8/1940 | Fischer et al. | 174/28 |
| 2,939,903 | A | 6/1960 | Lapsley et al. | |
| 3,191,132 | A * | 6/1965 | Mayer | H01B 11/12 123/633 |
| 3,248,473 | A * | 4/1966 | Buhmann | 174/29 |
| 3,309,455 | A | 3/1967 | Mildner | |
| 3,864,509 | A * | 2/1975 | Gommans | 174/28 |
| 4,758,685 | A | 7/1988 | Pote et al. | |
| 5,262,593 | A * | 11/1993 | Madry et al. | 174/102 R |
| 5,286,923 | A | 2/1994 | Prudhon et al. | |
| 5,298,682 | A * | 3/1994 | Salz | H01B 11/1869 174/105 R |
| 5,561,185 | A * | 10/1996 | Hashimoto et al. | 524/436 |
| 5,742,002 | A | 4/1998 | Arredondo et al. | |
| 6,495,763 | B1 * | 12/2002 | Eichmann et al. | 174/113 R |

(Continued)

OTHER PUBLICATIONS

C & M Corporation, Engineering Design Guide (3rd Edition), Jan. 1992, pp. 10-14.*

(Continued)

*Primary Examiner* — William H Mayo, III

(74) *Attorney, Agent, or Firm* — Foley & Lardner LLP

(57) ABSTRACT

Implementations of audio cables including a conductor spirally wrapped in a non-conductive thread to centrally position the conductor within a channel comprising mostly air include a first conductor having a first diameter, and a non-conductive thread spirally wrapped around the center conductor, the non-conductive thread having a second diameter. A first jacket surrounds the center conductor and thread, having an inner diameter approximately equal to the first diameter plus twice the second diameter. A second conductor surrounds the first jacket and/or the center conductor and thread. In many implementations, the first diameter is less than the second diameter.

12 Claims, 6 Drawing Sheets

(56) References Cited

U.S. PATENT DOCUMENTS

| | | | | |
|---|---|---|---|---|
| 6,583,360 | B1 * | 6/2003 | Yudashkin | H01B 11/1821 174/105 R |
| 6,812,401 | B2 * | 11/2004 | Karrmann | 174/28 |
| 7,795,536 | B2 * | 9/2010 | Plourde et al. | 174/102 R |
| 8,198,536 | B2 | 6/2012 | Clark | |
| 2004/0003937 | A1 * | 1/2004 | Vans Evers | H01B 11/12 174/113 R |
| 2004/0045731 | A1 * | 3/2004 | Garland | 174/36 |
| 2004/0074654 | A1 * | 4/2004 | Springer et al. | 174/28 |
| 2006/0124344 | A1 | 6/2006 | Clark et al. | |
| 2012/0073856 | A1 * | 3/2012 | Montena | H01B 11/1813 174/105 R |
| 2014/0251652 | A1 | 9/2014 | Poulsen et al. | |

OTHER PUBLICATIONS

Belden Technical Bulletin, Oct. 2011, all pages.*
Tara Labs, RSC Air Cable, published Jan. 21, 2010, 1 page.
Belden Inc., RG 62/U Type Coaxial Cable, published Aug. 11, 2012, 1 page.
Notice of Allowance for U.S. Appl. No. 14/163,795, dated Sep. 3, 2015.

* cited by examiner

SEMI-SOLID UNBALANCED AUDIO CABLE

RELATED APPLICATIONS

The present application claims priority to and the benefit of U.S. Provisional Application 61/920,618, entitled "Semi-Solid Balanced and Unbalanced Audio Cables," filed Dec. 24, 2013, the entirety of which is hereby incorporated by reference.

FIELD

The present application relates to audio cables. In particular, the present application relates to audio cables having a semi-solid region around a conductor.

BACKGROUND

Audio cables for interconnecting equipment, commonly referred to as interconnects, typically carry signals of 1 volt or less, including signals as low as 0.25 millivolts. These low-level signals can be easily distorted by capacitive, inductive, and dielectric effects. Additionally, as audio signals typically cover a wide frequency range of 10 octaves from 20 Hz to 20 kHz, propagation velocity of a signal through the interconnect may vary widely, depending on dielectric material. Specifically, the characteristic impedance of a cable $Z_0$ is defined as:

$$Z_0=[(R+j2\pi fL)/(G+j2\pi fC)]^{1/2}$$

with resistance R, conductance G, inductance L, capacitance C, imaginary unit j, and frequency f. Within the typical human audible range of around 20 Hz to 20 kHz, R is typically much larger than $j2\pi fL$ and $j2\pi fC$ is typically much larger than G, so the cable impedance can be simplified as:

$$Z_0=[R/j2\pi fC]^{1/2}$$

Accordingly, cable impedance at 20 Hz may be drastically different than impedance at 20 kHz, three orders of magnitude higher.

Dielectric material around a conductor will affect the propagation velocity of signals in the conductor. Specifically, the velocity factor VF or ratio of the velocity of the signal in the conductor to the velocity of a signal in vacuum (i.e. the speed of light, c) is the reciprocal of the square root of the dielectric constant of the material (e.g. 1 for vacuum). Air has a dielectric constant only slightly above that of vacuum (e.g. roughly 1.00059 at standard temperature and pressure). However, conductors surrounded or separated by air may be impractical: such conductors may need to be rigidly fixed in place to avoid short circuits or variations in geometry or spacing, leading to changes in capacitance. Accordingly, many cables employ polyethylene or similar material for structural support. For example, many coaxial cables surround a center conductor with a polyethylene foam, supporting an outer conductor. By using a foam containing a large portion of air, the dielectric constant of the material is reduced compared to solid polyethylene. However, the velocity factor of such cables may still be approximately 80%. As with self inductance or impedance effects, propagation velocity is similarly frequency dependent and, with wide differences between arrival times of low frequency components and high frequency components of an audio signal, can result in audible phase distortion and "smearing".

SUMMARY

To overcome signal velocity impairments in a cable, narrow gauge conductors may be used to reduce skin effect by ensuring that high frequency signals utilize the full depth of the conductor. For example, with a large diameter (low gauge) copper conductor with a radius measured in millimeters, a low frequency signal at 20 Hz may travel via the entire depth of the conductor, while a high frequency signal at 20 kHz may travel only via a thin layer on the outside of the conductor less than a millimeter in depth. Accordingly, by using conductors with a radius equal to the sub-millimeter skin depth, both low and high frequency signals will travel via the entire conductor. Additionally, the amount of non-air dielectric material surrounding a conductor may be reduced while still maintaining position and structural support by spirally wrapping the conductor with a non-conductive thread or bead of material, or a plastic or dielectric coated thread, with an air void formed between the conductor and a jacket and/or outer conductor supported by the thread. Because the strength of a magnetic field around a conductor is inversely proportional to the square of the distance from the conductor, a polyethylene foam dielectric material creates a gradient of dielectric effect that is strongest immediately adjacent to the conductor, and is thus inferior to even a small air gap around the conductor, which results in a step function for the dielectric effect. The diameter of the thread or bead may be selected to maximize the percentage of air within the jacket and/or outer conductor, resulting in the maximum possible velocity factor, and a minimum of contact between the thread and conductor.

In one aspect, the present disclosure is directed to a coaxial audio cable. The cable includes a first conductor having a first diameter, and a non-conductive thread spirally wrapped around the center conductor, the non-conductive thread having a second diameter. In some implementations, a first jacket surrounds the center conductor and thread, having an inner diameter approximately equal to the first diameter plus twice the second diameter. A second conductor surrounds the first jacket and/or the center conductor and thread. In many implementations, the first diameter is less than the second diameter.

In some implementations, the audio cable includes a second jacket surrounding the second conductor. In many implementations, the first conductor is approximately centered in the cable. In some implementations, a region between the first jacket and first conductor is filled by the thread by less than 30%. In other implementations, the first diameter is between 40-60% of the second diameter. In still other implementations, the first diameter is between 40-50% of the second diameter. In many implementations, the thread has a circular cross-section.

In some implementations, the audio cable includes a channel formed by an inner surface of the first jacket, and a sum of the cross-sectional areas of the first conductor and thread is equal to less than 30% of a cross-sectional area of the channel. In a further implementation, the channel contains air. In many implementations, the first diameter is between 40-50% of the second diameter.

In some implementations of the audio cable, the thread has a circular cross-section. In other implementations, the first jacket has a circular cross-section. In still other implementations, the second conductor includes a conductive braid and/or a conductive foil shield. In many implementations, the audio cable terminates in a connector attached to the first conductor and second conductor.

In another aspect, the present disclosure is directed to an audio cable with a first conductor, and an inner jacket surrounded by the first conductor. The cable also includes a non-conductive thread configured in a spiral within the inner jacket, and a second conductor in contact with the non-conductive thread and approximately centered within the inner jacket.

In some implementations, the first conductor has a toroidal cross section. In other implementations, the second conductor is approximately centered within the first conductor. In still other implementations, an inner diameter of the inner jacket is larger than the sum of a diameter of the thread and a diameter of the second conductor. In some implementations, the cable includes an outer jacket surrounding the first conductor. In other implementations, the cable includes a channel formed by an inner surface of the inner jacket, and a sum of the cross-sectional areas of the second conductor and thread is equal to less than 30% of a cross-sectional area of the channel. In a further implementation, the channel contains air.

The features of unbalanced coaxial cables described herein may also be applied to balanced audio cables. In one such implementation, a non-conductive filler material having a cross-shaped cross section is centered within the cable, with conductors positioned within channels or air voids between each arm of the filler. To maintain positioning of the conductors in the centers of the corresponding channels, each conductor may be spirally wrapped with a non-conductive thread as discussed above in the implementations of unbalanced coaxial cables. Diagonally opposite conductors may be wired together in a configuration sometimes referred to as "star-quad". Because the position of each conductor is tightly controlled, common mode interference rejection is improved. As discussed above, self-inductance is reduced with the use of smaller individual conductors. However, in typical star-quad configurations, capacitance is increased due to the proximity of the conductors. By spacing the conductors via the filler and air voids, capacitance is significantly reduced. Simultaneously, propagation velocity is maximized to nearly 100% of the theoretical maximum at the interface of the conductor and dielectric through the removal of dielectric material compared to foamed polyethylene cables. As discussed above, by removing dielectric material in the region immediately surrounding the conductor where the magnetic field is strongest, the most significant effects from the dielectric material come from the surrounding jacket, which, being spaced from the conductor by air, results in a dielectric constant that has a step function over distance from the conductor, compared to a gradient as in foamed dielectric cables.

In one aspect, the present disclosure is directed to a balanced audio cable. The cable includes a radially symmetric filler comprising a plurality of arms forming a corresponding plurality of channels. The cable also includes a plurality of conductors, each approximately centered within a corresponding channel. The cable further includes a plurality of non-conductive threads, each spirally wrapped around a conductor of the plurality of conductors. In some implementations, the cable also includes a jacket surrounding the filler, conductors, and threads.

In one implementation, the cable includes a plurality of second jackets, each surrounding a conductor and corresponding thread and supported within a channel by adjacent arms of the filler. In a further implementation, each conductor has a first diameter, each thread has a second diameter, and each of the plurality of second jackets has an inner diameter approximately equal to the first diameter plus twice the second diameter. In other implementations, each conductor has a first diameter, each thread has a second diameter, and the first diameter is between 40-60% of the second diameter. In another implementation, each thread has a circular cross-section. In still another implementation, each arm of the filler terminates in a broadened region such that each channel has an approximately pentagonal border. In some implementations, each channel is filled by the corresponding thread by less than 30%.

In many implementations, the cable includes a second conductor surrounding the jacket, and a second jacket surrounding the second conductor. In some implementations, the second conductor includes a conductive braid, while in other implementations, the second conductor includes a conductive foil. In some implementations, the second jacket includes an inner plastic layer and an outer textile layer.

In some implementations of the audio cable, a sum of the cross-sectional areas of a first conductor and corresponding thread wrapped around said first conductor is equal to less than 30% of a cross-sectional area of the corresponding channel formed by adjacent arms of the filler. In many implementations, each channel contains air.

In some implementations of the audio cable, the first jacket has a circular cross-section. In many implementations of the audio cable, the cable terminates in an electrical connector having a first portion attached to at least one of the plurality of first conductors and a second portion attached to a second at least one of the plurality of first conductors. In one such implementations, a first pair of first conductors positioned in diagonally opposing channels is attached to the first portion of the connector and a second pair of first conductors positioned a second set of diagonally opposing channels is attached to the second portion of the connector. In another implementation, a second conductor surrounding the first jacket is attached to a third portion of the connector. In still another implementation, the plurality of non-conductive threads are each spirally wrapped around the corresponding first conductor with a first lay direction; and the filler is twisted in a second, opposing lay direction.

In still another aspect, the present disclosure is directed to an audio cable include a jacket, and a filler positioned within the jacket, the filler comprising a plurality of arms forming a corresponding plurality of channels. In some implementations, the filler may be radially symmetric. The cable includes a plurality of non-conductive threads, each configured in a spiral within a corresponding channel of the plurality of the channels. The cable also includes a plurality of first conductors, each in contact with a thread and approximately centered within a corresponding channel of the plurality of channels.

In some implementations, the cable includes a second conductor surrounding the jacket. In other implementations, an inner diameter of each channel is larger than the sum of a diameter of the thread and the diameter of the first conductor positioned within said channel.

The present disclosure describes methods of manufacture and implementations of semi-solid unbalanced and balanced audio cables.

BRIEF DESCRIPTION OF THE FIGURES

In the drawings, like reference numbers generally indicate identical, functionally similar, and/or structurally similar elements. The drawings are not shown to scale, and sizes of various components and features of the drawings may be different in various embodiments.

DETAILED DESCRIPTION

Signal velocity in a coaxial cable is affected by self inductance due to skin effect and the dielectric material between the conductors. The former may be minimized by using smaller gauge wires, while the latter may be minimized by removing as much of the dielectric material as possible, as air has a dielectric constant nearly equal to that of vacuum.

In some implementations of a semi-solid coaxial cable, a center conductor may be spirally wrapped with a non-conductive thread. The thread may support a jacket and keep the conductor centered within the cable, while providing an air void around the conductor. The jacket may be surrounded by a conductive braid or another conductor, and in many implementations, an another outer jacket. In order to keep the conductor centered, the inner diameter of the inner jacket is roughly equal to the conductor diameter plus twice the thread diameter.

Figure 1A:
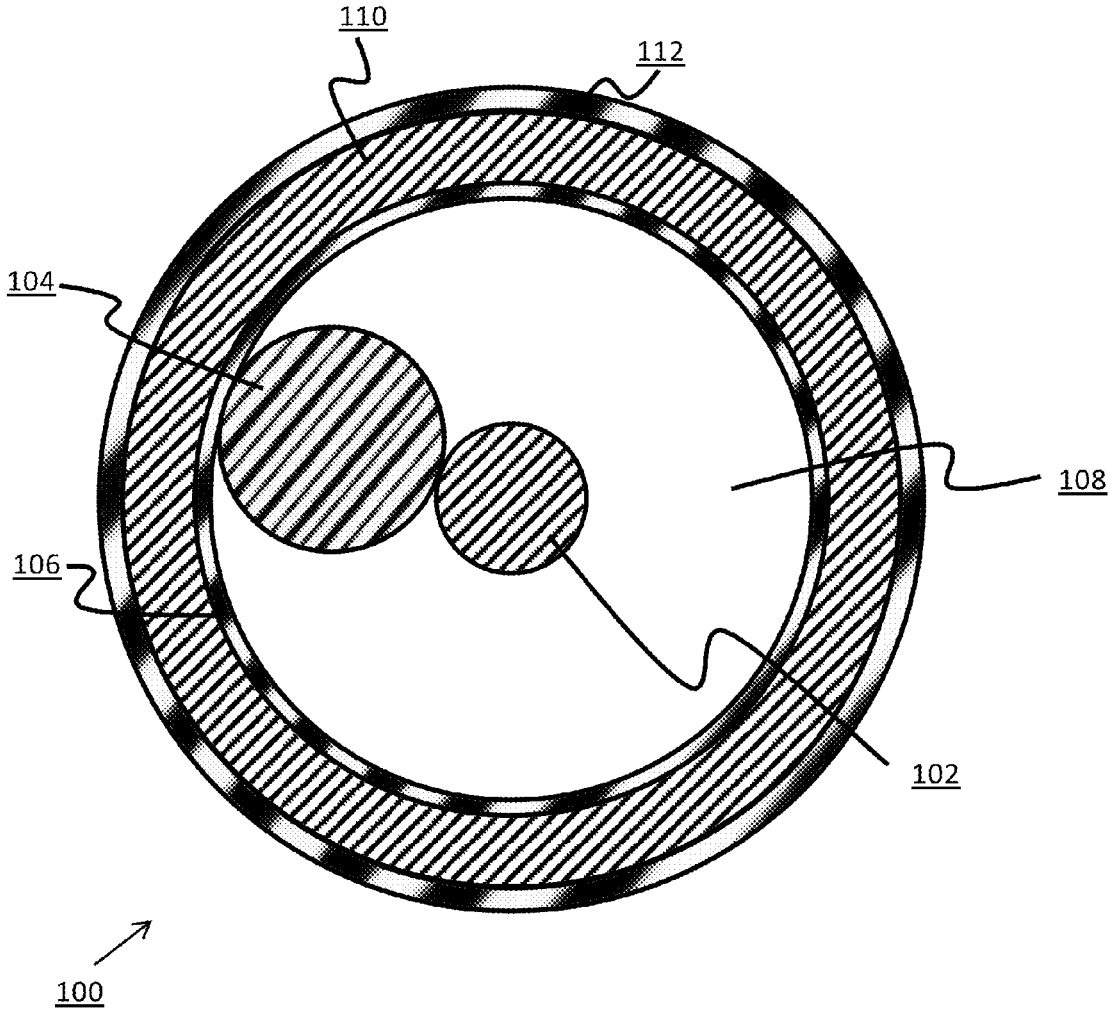
FIG. 1A is a cross section of an embodiment of a semi-solid coaxial audio cable.

FIG. 1A is a cross section of an embodiment of a semi-solid coaxial audio cable 100. In brief overview, a center conductor 102 is spirally wrapped by a non-conductive thread 104. The thread supports an inner jacket 106 and centers the center conductor 102 within a tube 108, which may comprise mostly air. The inner jacket 106 may be surrounded by an outer conductor 110, which may itself be surrounded by an outer jacket 112.

Still referring to FIGS. 1A and 1*n* more detail, a coaxial cable 100 includes a center conductor 102 and an outer conductor 110. Conductors 102, 110 may be of any conductive material, such as copper or oxygen-free copper (i.e. having a level of oxygen of 0.001% or less) or any other suitable material, including Ohno Continuous Casting (OCC) copper or silver. As shown, center conductor 102 may be approximately centered within cable 100. To provide uniformity of skin depth for signals in the audible band from 20 Hz to 20 kHz, the center conductor 102 may be very small, such as less than 20 AWG.

A thread 104 may be spirally wrapped around center conductor 102 to position the center conductor within the tube 108 and support inner jacket 106. To keep the center conductor 102 centered, the sum of the diameter of conductor 102 and twice the diameter of thread 104 are approximately equal to the inner diameter of inner jacket 106. In practice, center conductor 102 may be distorted from a straight line during the spiral wrapping of thread 104, leading to variations in capacitance between inner conductor 102 and outer conductor 110. Larger diameter conductors 102 may reduce this distortion, at the expense of greater self-inductance and skin effect at high frequencies. Accordingly, many implementations may use as narrow a center conductor 102 as possible that has minimal distortion from a center position within the coaxial cable, responsive to material stiffness and tensile strength. In some implementations, the conductor 102 may be less than 20 AWG, such as 24 AWG, 25 AWG, 26 AWG, or any other such size.

Thread 104 may comprise any type or form of non-conductive material, including fluorinated ethylene propylene (FEP) or polytetrafluoroethylene (PTFE) Teflon®, high density polyethylene (HDPE), low density polyethylene (LDPE), polypropylene (PP), or any other type of insulating and/or low dielectric constant material. As shown, thread 104 may have a circular or substantially circular cross section, resulting in nearly zero contact between thread 104 and conductor 102 (for theoretical infinitely stiff thread 104 and conductor 102). This may further reduce propagation velocity reductions due to interactions of the dielectric material of thread 104 and conductor 102. Thread 104 may have a degree of twist or lay selected as a compromise of providing sufficient support for jacket 106 while maximizing the percentage of air in tube 108 per unit length. For example, in some implementations, thread 104 may make a complete circle around conductor 102 once per centimeter, once per inch, once per two inches, or any other such length.

Figure 1B:
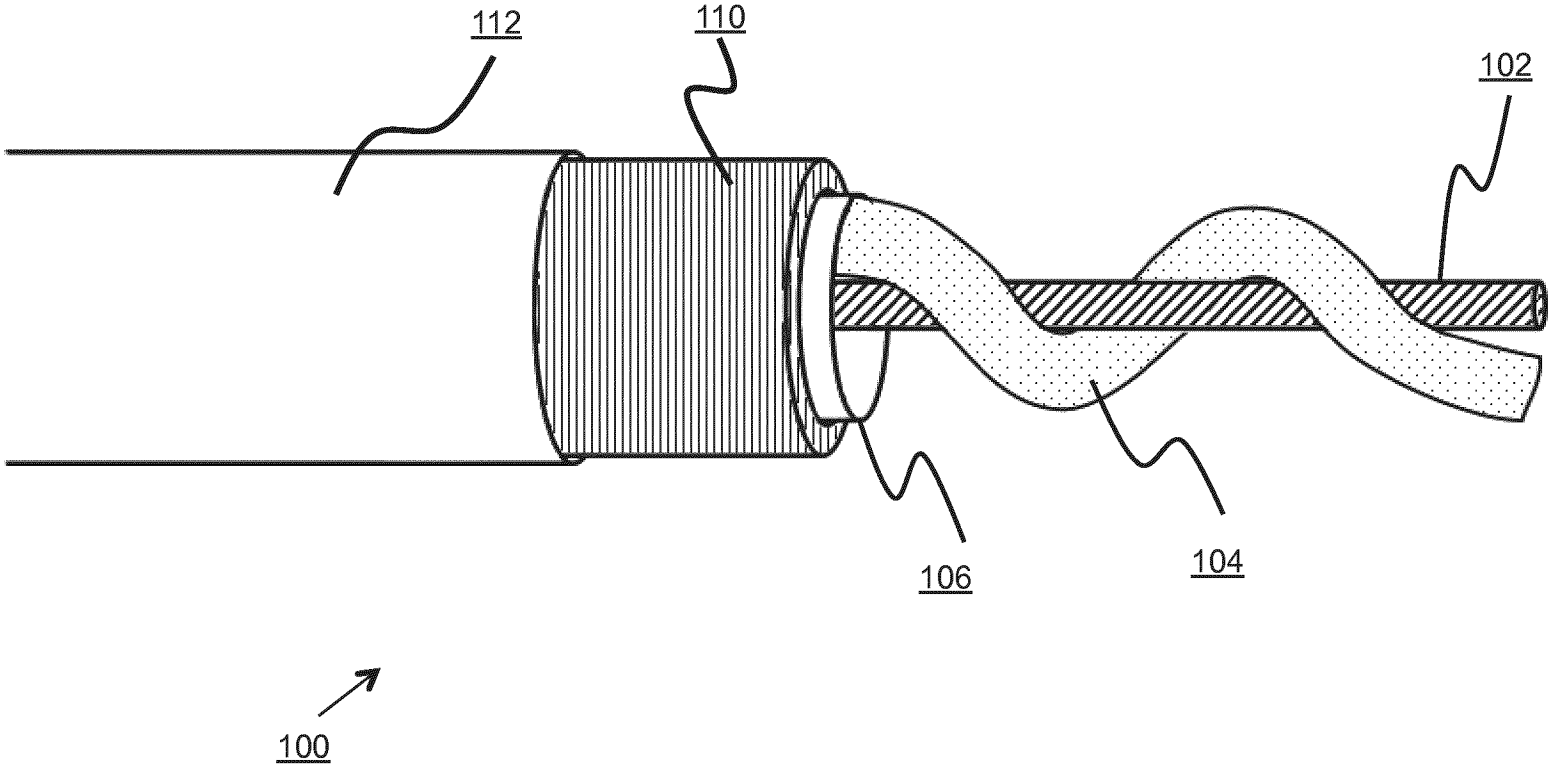
FIG. 1B is a cutaway side view of the embodiment of a semi-solid coaxial audio cable of FIG. 1A.

Turning briefly to FIG. 1B, illustrated is a cutaway side view of the embodiment of a semi-solid coaxial audio cable of FIG. 1A. As shown, thread 104 may spirally wrap around inner conductor 102. Thread 104 may have a clockwise or counter-clockwise wrap.

Returning to FIG. 1A, as discussed above, thread 104 and conductor 102 may be surrounded by an inner jacket 106, forming a tube 108 comprising mostly air. In some implementations, other gases than air may be employed, including oxygen-free gases to reduce oxidation of conductor 102, such as nitrogen. Jacket 106 may be of any type or form of material, including FEP, PTFE, HDPE, LDPE, PP, rubber, plastic, fabric, or any other type of non-conductive material. Because jacket 106 is adjacent to conductor 110, jacket 106 may be selected from materials having a low dielectric constant (e.g. 1-3) relative to air, to reducing capacitance between conductors 102, 110. The insulation may also have a high dielectric strength, such as 400-4000 V/mil, allowing thinner walls and similarly reducing the amount of dielectric material by expanding the size of tube 108. For example, in some implementations, the jacket 106 may have an inner diameter of less than 0.1 inches, and an outer diameter of less than 0.2 inches. In some such implementations, the jacket 106 may have an outer diameter of less than 0.15, 0.14, or 0.13 inches.

Jacket 106 may be surrounded by an outer conductor 110. As shown, in many implementations, outer conductor 110 may have a cross section of a toroid. As discussed above, outer conductor 110 may comprise any type and form of conductor, including copper or oxygen-free copper or any other suitable material, including Ohno Continuous Casting (OCC) copper or silver. In some implementations, outer conductor 110 may comprise a braid of many individual narrow gauge wires, providing flexibility with low direct current resistance. Specifically, when unbalanced audio cables are used as interconnects, the signal grounds of attached components are linked. Any ground level differences between the components will allow a "new" signal current to flow between component inputs and outputs. The unwanted ground current is multiplied by the shield resistance and produces a "signal" that may have a level similar to the small signal levels of moving coil (MC) devices, such as phonograph transducers. In practice, it may be difficult to ensure that different components are at the same electrical ground level. Accordingly, to remove the unwanted ground current noise, it shield resistance may be reduced through the use of large outer conductors 110 or heavy braids.

In some implementations, an outer jacket 112 may surround outer conductor 110. As with inner jacket 106, outer jacket 112 may be of any type or form of material, including FEP, PTFE, HDPE, LDPE, PP, rubber, plastic, fabric, polyvinyl chloride (PVC), or any other type of jacket material or combinations of such materials. For example, in one embodiment, an outer jacket 112 may comprise a textile inner jacket and PVC outer jacket for durability. The outer PVC jacket may be clear or tinted in various embodiments. In other embodiments, the jacket may comprise a nylon outer jacket over a PVC jacket for further increased durability. In some embodiments, jacket 112 may be flame resistant or designed to produce a plenum- or riser-rated cable. Frequently, jacket 112 may be printed, imprinted, silk screened, or otherwise labeled with model numbers, types, distance markings, or any other such data.

In some implementations not illustrated, a shield may be provided between outer conductor 110 and outer jacket 112, such as a foil shield or other such shield, to further reduce direct current resistance of the outer conductor and/or reduce electrostatic interference.

For a fixed inner diameter of inner jacket 106, the amount of air void within tube 108 is related to the ratio of the diameter of the conductor 102 to the diameter of the thread 104, but not in a linear relationship. Instead, the percentage of air void is proportional to the total area inside the inner jacket 106 minus the sum of the area of the conductor 102 and the area of the thread 104, or:

$$
\begin{aligned}
\%\ \text{air} &= \text{area of air}/\text{area inside jacket 106} \\
&= [\text{area inside jacket 106} - (\text{area of conductor 102} + \\
&\quad \text{area of thread 104})]/\text{area inside jacket 106} \\
&= [\pi * (\text{jacket 106 inner diameter}/2)\hat{}2 - \\
&\quad (\pi * [\text{conductor 102 diameter}/2]\hat{}2 + \\
&\quad \pi * [\text{thread 104 diameter}/2]\hat{}2)]/ \\
&\quad [\pi * (\text{jacket 106 inner diameter}/2)\hat{}2] \\
&= [\pi * (\text{jacket 106 inner diameter}/2)\hat{}2 - \\
&\quad (\pi * [\text{conductor 102 diameter}/2]\hat{}2 + \\
&\quad \pi * [((\text{jacket 106 inner diameter} - \text{conductor 102} \\
&\quad \text{diameter})/2)/2]\hat{}2)]/[\pi * \\
&\quad (\text{jacket 106 inner diameter}/2)\hat{}2]
\end{aligned}
$$

Figure 2:
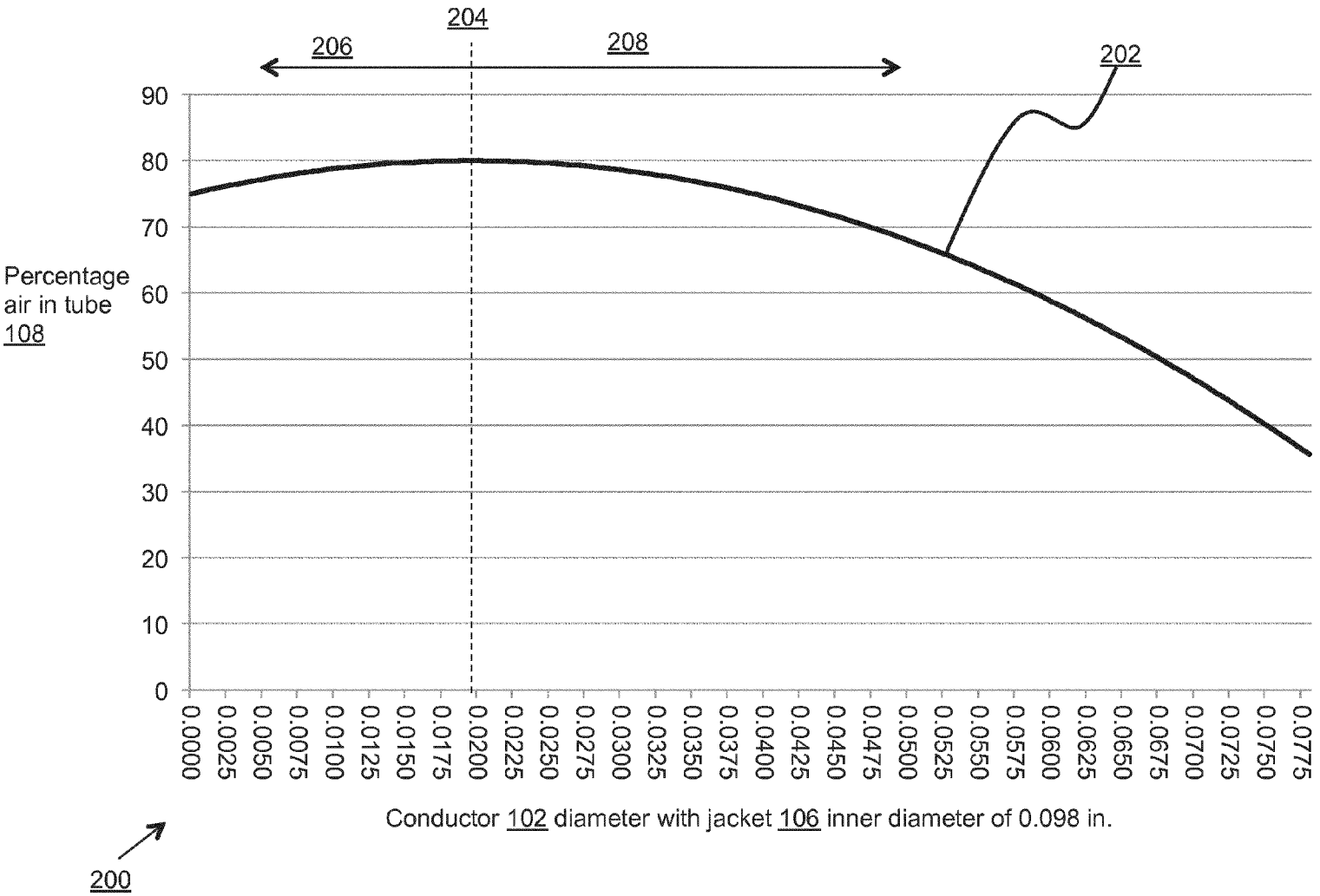
FIG. 2 is a chart of percentage of air void compared to center conductor diameter for a fixed inner diameter of a tube for the embodiments of semi-solid coaxial audio cables of FIGS. 1A-1B.

This function 202 is illustrated in the chart 200 of FIG. 2 with percentage of air within tube 108 compared to center conductor 102 diameter for the embodiments of semi-solid coaxial audio cables of FIGS. 1A-1B. The example values shown are for a fixed inner diameter of jacket 106 equal to 0.098 inches. However, the same relationship holds for any jacket diameter, such that the percentage of air space is maximized when the conductor 102 diameter is equal to 50% of the thread 104 diameter, with 80% air within the tube 108 at point 204. For example, as illustrated, air percentage is maximized with conductor diameter of 0.0196 inches and thread diameter of 0.0392 inches, with jacket inner diameter of (0.0196+2*(0.0392)) or 0.098 inches. The percentage of air approaches this value asymptotically, so variations in conductor 102 and thread 104 diameters are acceptable. For example, in some implementations, the percentage of air may be above approximately 70%; or, in other words, the thread and conductor may fill less than 30% of the channel. However, as the wire size increases from peak 204 in region 208, capacitance between the inner and outer conductors increases. Accordingly, in some implementations, inner conductor diameters of less than 50% of the thread diameter, corresponding to region 206, may be utilized to provide acceptably low capacitance with high propagation velocity. Thus, in various implementations, the diameter of inner conductor may be between 40-60% of the thread diameter, and in many implementations, the diameter may be between 40-50% of the thread diameter.

Accordingly, a coaxial cable constructed according to the implementations discussed herein provides high propagation velocity across the audible band with low self-inductance due to the removal of dielectric material and low capacitance due to the maintained geometry and spacing between conductors. For example, in some implementations, capacitance may be less than 12 pF/foot. Inductance may also be low, with many implementations having inductance of less than 0.15 μH/foot. Propagation velocity may be greater than 80% of c, with many implementations having propagation velocity greater than 85% or 88% of c. The cable may, in many implementations, be terminated with a connector or connectors, such as an RCA or phono-type connector, spade or ring connector, or any other type of connector, or may be connected to a terminal block, binding posts, or other such connections.

Although discussed primarily in terms of cables having a round cross section, with outer conductors or jackets having toroidal cross sections, in some implementations, the same techniques may be applied to cables having other cross sections. For example, in one such implementation in which the cable is a "flat" cable having a rectangular cross section, the center conductor may have a rectangular profile, and the thread may be wrapped around the center conductor to support an inner jacket having a similar, larger rectangular cross section, while maintaining an air channel between the inner jacket and the center conductor.

Additionally, the combination of inner conductor and thread may be utilized as a subcomponent of a balanced audio cable. A plurality of units, each comprising a conductor and spirally wrapped thread, may be provided to carry opposing polarities or legs of a signal to be summed to reject common mode interference. In one implementation, four units may be provided in a star-quad configuration with diagonally opposing pairs wired together as a single leg. The average position of each leg is therefore in the center of the cable, maximizing common mode rejection. A filler or spacer may be provided between the four units, with channels for each unit formed between adjacent arms of the filler. The filler may maintain the geometry of the units in a square, even in the presence of external physical forces that would otherwise distort the units into a trapezoid or other shape. Additionally, by maintaining the spacing of the units, capacitance between the signal legs is reduced compared to star-quad cables without fillers, due to the increased inter-conductor distance.

Figure 3A:
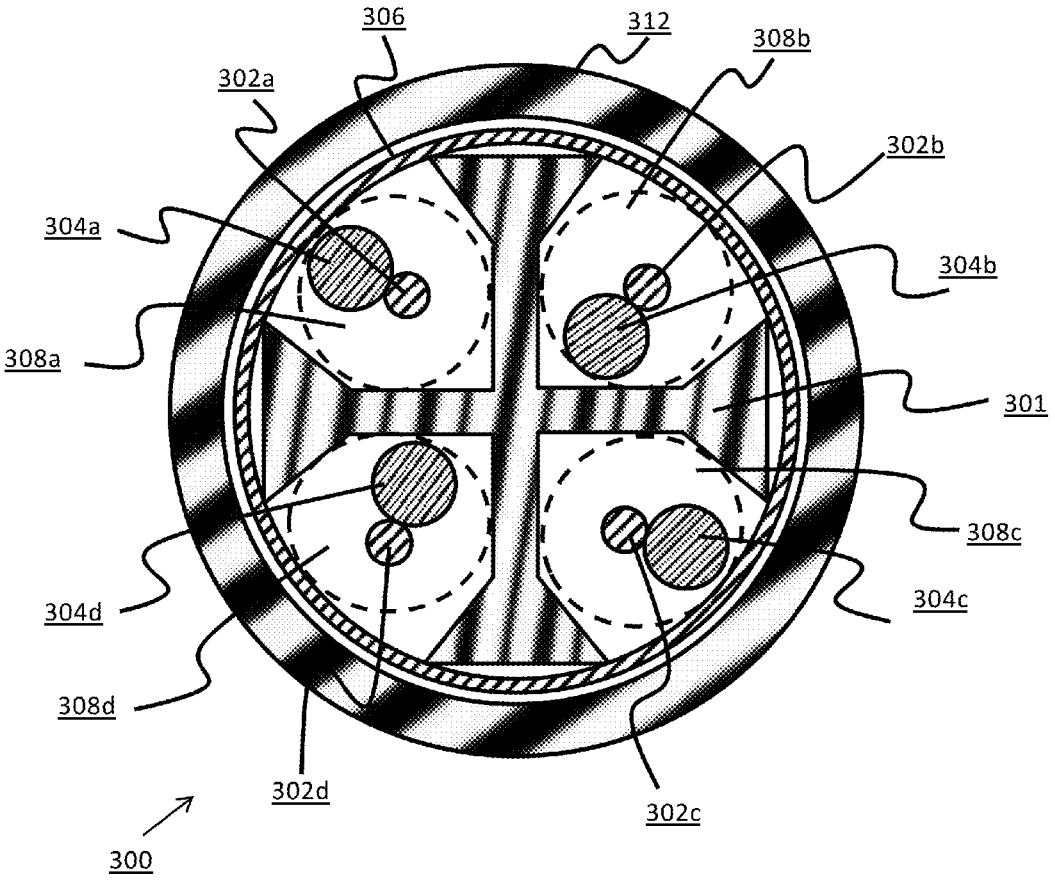
FIG. 3A is a cross section of an embodiment of a semi-solid audio cable incorporating a filler.

Referring now to FIG. 3A, illustrated is a cross section of an embodiment of a semi-solid audio cable 300 incorporating a filler 301. Cable 300 may include a filler 301 with a cross-shaped cross section providing channels or tubes 308*a*-308*b* (referred to generally as channel(s) 308), similar to tube 108 of FIG. 1A. A conductor 302*a*-302*d* (referred to generally as conductor(s) 302), similar to conductor 102, may be positioned in the center of each corresponding channel 308*a*-308*d*. Each conductor 302*a*-302*d* may be spirally wrapped with a corresponding thread 304*a*-304*d* (referred to generally as thread(s) 304), similar to thread 104.

As discussed above in connection with FIG. 2, the percentage of air surrounding each conductor 302 within each corresponding channel 308 may be maximized via function 202 discussed above for conductor 302 diameters and thread 304 diameters, to approximately 80% air surrounding each conductor 302 within channel 308 in some embodiments. Accordingly, the performance of the balanced version of the cable with respect to signal propagation velocity and inductance may be substantially similar to the performance of the unbalanced version of the cable discussed above, while enjoying the benefit of increased noise reduction through common mode rejection of electromagnetic interference on the separate legs of the cable. For example, a channel 308 with a volume of 0.00756 square inches is similar to the 0.00754 square inches volume of the unbalanced cabled with inner jacket inner diameter of 0.098 inches discussed above (albeit in a pentagon or "v-shape"), and may thus utilize a conductor with a diameter of 0.0196 inches and thread with diameter of 0.0392 inches to achieve an approximately 80% air space. For example, the table below shows the results of measurements of capacitance, inductance, and propagation velocity for one such embodiment of a semi-solid balanced cable, along with corresponding measurements for an embodiment of a semi-solid unbalanced cable having similar sizes:

| | Unbalanced semi-solid cable | Balanced semi-solid cable |
|---|---|---|
| Chamber volume | 0.00754 square inches | 0.00756 square inches |
| Conductor diameter | 0.0201 inches (24 AWG) | 0.0201 inches (24 AWG) |
| Thread diameter | 0.0390 inches | 0.0400 inches |
| Capacitance | 13.7 pF/foot | 10.0 pF/foot |
| Inductance | 0.157 μH/foot | 0.147 μH/foot |
| Velocity of Propagation | 86.8% of c | 87.2% of c |

Returning to FIG. 3A, in some implementations, each unit of a conductor 302 and corresponding thread 304 may be surrounded by a jacket (illustrated in dashed line), while in other implementations, the conductor/thread pairs may not be individually jacketed. In many implementations, an inner jacket 306, similar to inner jacket 106, may surround filler 301 and conductors 302/threads 304. In some implementations, inner jacket 306 may be replaced by a conductive braid and/or foil shield to provide protection from electrostatic interference. In other implementations, a conductive braid and/or foil shield may be placed around inner jacket 306. Signal to ground capacitance due to inner jacket 306 may be reduced compared to typical cables due to the spacing between conductors 302 and the inner jacket 306, supported by filler 301 with conductors 302 centered within each channel.

In many implementations, the cable 300 may include an outer jacket 312 surrounding the inner jacket 306 and/or foil shield, filler 301, and conductors 302/threads 304. Outer jacket 312 may comprise any type and form of material, including FEP, PTFE, HDPE, LDPE, PP, rubber, plastic, fabric, polyvinyl chloride (PVC), or any other type of jacket material or combinations of such materials. For example, in one embodiment, an outer jacket 312 may comprise an inner textile jacket and outer PCV jacket, a PVC and nylon jacket, or any other type and form of material or combination of materials for increased durability. In some embodiments, outer jacket 312 may be flame resistant or designed to produce a plenum- or riser-rated cable. Frequently, outer jacket 312 may be printed, imprinted, silk screened, or otherwise labeled with model numbers, types, distance markings, or any other such data.

Figure 3B:
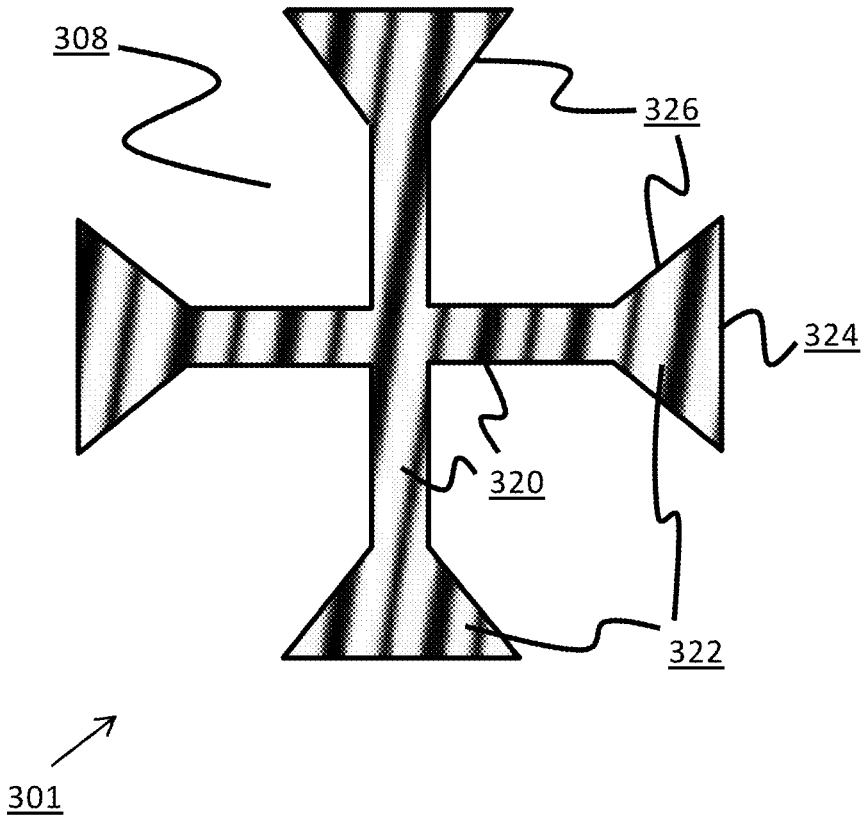
FIG. 3B is a cross section of an embodiment of the filler of FIG. 3A.

FIG. 3B is a cross section of an embodiment of the filler 301 of FIG. 3A. Filler 301 may be of a non-conductive material such as flame retardant polyethylene (FRPE) or any other such low loss dielectric material. As shown, filler 301 may have a cross-shaped cross section with arms 320 radiating from a central point and terminating in enlarged portions or anvils 322 having end surfaces 324 and angled sides 326. Each arm 320 and anvil 322 may surround a channel 308, separating pairs of units of conductors 302 and threads 304, and providing structural stability to cable 300. Angled sides 326 and arms 320 may form four sides of a pentagon enclosing a channel 308. As discussed above, in many embodiments, each channel 308 may have a volume similar to the volume of channels 108 in embodiments of semi-solid unbalanced cables. Accordingly, function 220 discussed above may be used to select conductor 302 and thread 304 sizes to maximize air volume within channels 308. The filler allows a cylindrical shape for optimized ground plane uniformity and stability for improved capacitance stability cross the audio band. By physically separating conductors 302 carrying different polarities of a signal, capacitance may be reduced over cables with physically adjacent insulated conductors. Similarly, by providing structural support for air-filled channels, dielectric material is removed compared to such cables, as discussed above in connection with the unbalanced coaxial cable.

Filler 301 may be of any size, depending on the diameter of the channels 308 desired. For example, in one embodiment of a cable with an outer diameter of approximately 0.275", the filler may have an anvil edge to anvil edge measurement of approximately 0.235". Although shown symmetric, in some embodiments, the anvils 322 may have asymmetric profiles. Similarly, although shown flat, in some embodiments end surfaces 324 may be curved to match an inner surface of a circular jacket of cable 300.

Figure 3C:
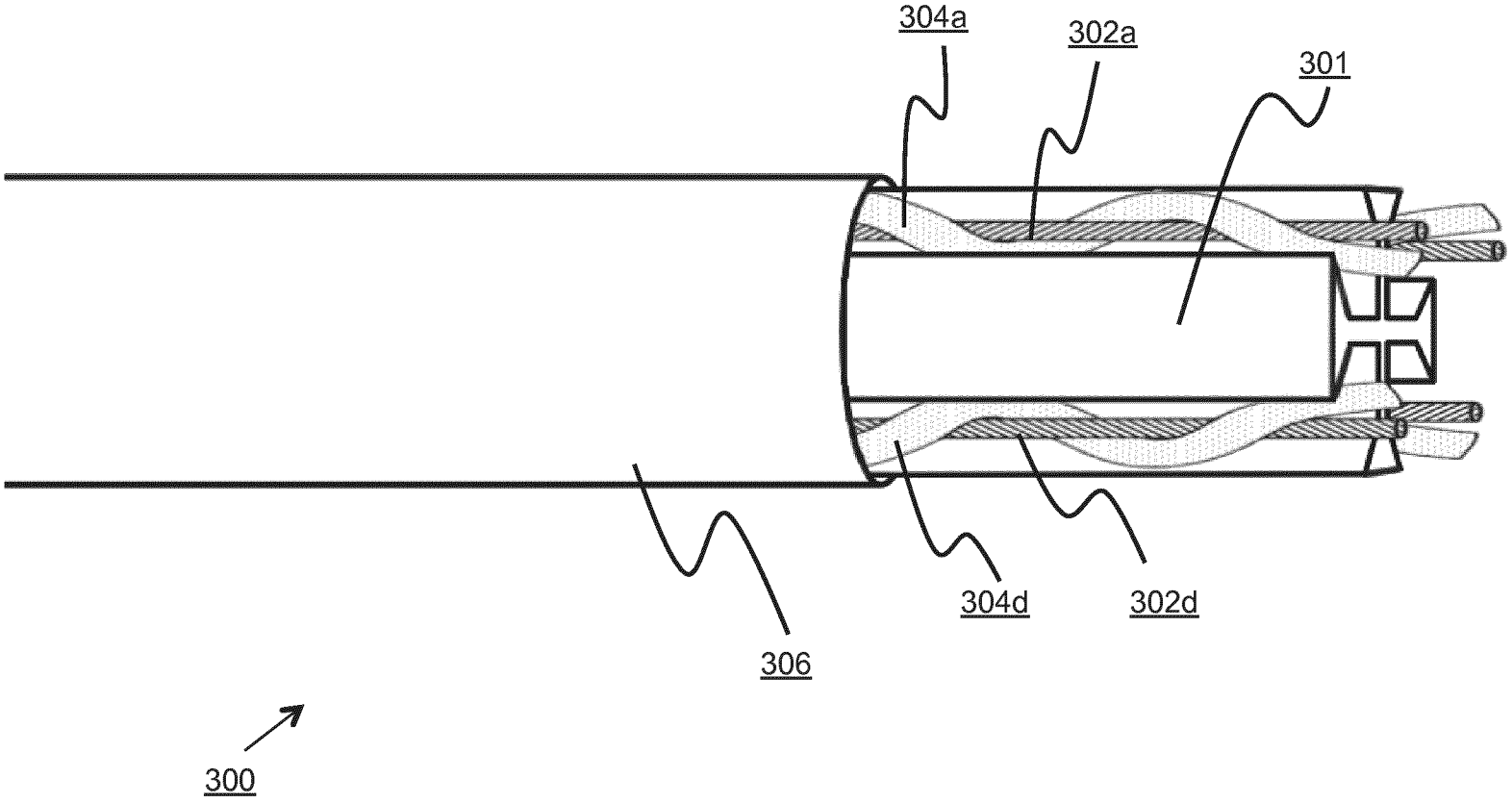
FIG. 3C is a cutaway side view of a the embodiment of a semi-solid audio cable incorporating a filler of FIG. 3A.

FIG. 3C is a cutaway side view of an embodiment of a portion of a semi-solid audio cable 300 incorporating a filler 301 of FIG. 3A. Outer jacket 312 and/or conductive braid or foil shields are not illustrated. As shown, each pair of conductors 304 and threads 302 may be positioned within channels formed between arms of the filler 301, with position of each conductor in the center of its corresponding channel maintained via the spirally wrapped thread in conjunction with filler 301 and inner jacket 306. In many implementations, the cable 300 may be terminated in a connector, such as an XLR connector, tip-ring-sleeve (TRS) connector, or any other type and form of connector.

Although illustrated in FIG. 3C with different directions of spiral wrapping or "lay" of the thread 304 around conductor 302 (e.g. a clockwise or right hand lay for thread 304*a* and a counter-clockwise or left hand lay for thread 304*d*), in many implementations, each thread 304*a*-304*d* may have the same direction of spiral or lay. The lay or wrapping may have any length, such as one complete revolution of thread 304 around a conductor 302 per foot, one revolution per yard, two revolutions per foot, six revolutions per foot, or any other such rate. The rate may be selected to maximize air volume within each channel while still supporting each conductor 302.

Furthermore, the overall cable 300 may have a twist or lay, with filler 301 (and conductor/thread pairs) rotated around the axis of the cable along its length (not illustrated). The cable lay may also be of any length, such as one complete revolution per foot, one revolution per yard, two revolutions per foot, six revolutions per foot, or any other such rate. In some implementations, the cable lay may be the same as each thread lay (e.g. right-hand cable lay and right-hand thread lay). In other implementations, the cable lay may be different from the thread lay. For example, in one such implementation, the thread lay may be a right-hand lay, and the cable lay may be a left-hand lay, or vice versa. In such implementations, the reversed direction of the cable lay may serve to "untwist" the threads, reducing tension on each thread around the corresponding conductor. This reduced tension may help maintain the positioning of the conductor within each corresponding conductor, by reducing pressure from the thread that would distort the path of the conductor. In some implementations, the reduced tension may also result in the thread partially losing contact with the conductor, resulting in a small additional channel of air immediately adjacent to the conductor in the region where the magnetic fields are strongest. This may further reduce dielectric effect, as discussed above.

The above description in conjunction with the above-reference drawings sets forth a variety of embodiments for exemplary purposes, which are in no way intended to limit the scope of the described methods or systems. Those having skill in the relevant art can modify the described methods and systems in various ways without departing from the broadest scope of the described methods and systems. Thus, the scope of the methods and systems described herein should not be limited by any of the exemplary embodiments and should be defined in accordance with the accompanying claims and their equivalents.

What is claimed:

1. An audio cable, comprising:

a first conductor having a first diameter;

a non-conductive thread spirally wrapped around the first conductor having a second diameter;

a first jacket surrounding the first conductor and thread, having an inner diameter approximately equal to the first diameter plus twice the second diameter; and a second conductor contacting the first jacket; and a channel formed by an inner surface of the first jacket;

wherein a sum of the cross-sectional areas of the first conductor and thread is equal to less than 30% of a cross-sectional area of the channel.

2. The audio cable of claim 1, wherein the first diameter is less than the second diameter.

3. The audio cable of claim 1, further comprising a second jacket surrounding the second conductor.

4. The audio cable of claim 3, wherein the second jacket comprises an inner plastic layer and an outer textile layer.

5. The audio cable of claim 1, wherein the first conductor is approximately centered in the cable.

6. The audio cable of claim 1, wherein the channel contains air.

7. The audio cable of claim 1, wherein the first diameter is between 40-50% of the second diameter.

8. The audio cable of claim 1, wherein the thread has a circular cross-section.

9. The audio cable of claim 1, wherein the first jacket has a circular cross-section.

10. The audio cable of claim 1, wherein the second conductor comprises a conductive braid or foil shield.

11. The audio cable of claim 1, further comprising a connector attached to the first conductor and second conductor.

12. The audio cable of claim 1, wherein a difference between the inner diameter of the first jacket and an outer diameter of the first jacket is less than a difference between an inner diameter of the second conductor and an outer diameter of the second conductor.

* * * * *